United States Patent [19]

Guilhem

[11] 4,388,810

[45] Jun. 21, 1983

[54] STORAGE TANK FOR LIQUEFIED GAS SUCH AS METHANE

[75] Inventor: Michel Guilhem, Au, Switzerland

[73] Assignee: Gaz de France, Paris, France

[21] Appl. No.: 352,757

[22] Filed: Feb. 26, 1982

[30] Foreign Application Priority Data

Mar. 19, 1981 [FR] France ..... 81 05497

[51] Int. Cl.[3] ..... F17C 3/00

[52] U.S. Cl. ..... 62/47; 62/45; 220/426

[58] Field of Search ..... 62/45, 47; 220/426

[56] References Cited

U.S. PATENT DOCUMENTS

| | | | |
|---|---|---|---|
| 2,513,749 | 5/1950 | Schilling | 62/45 |
| 2,897,657 | 8/1959 | Rupp | 62/45 |
| 3,136,135 | 6/1963 | Rigby et al. | 62/45 |
| 3,545,226 | 12/1970 | Newell | 62/46 |

FOREIGN PATENT DOCUMENTS

| | | |
|---|---|---|
| 1293976 | 4/1962 | France . |
| 1294929 | 4/1962 | France . |

*Primary Examiner*—Ronald C. Capossela

*Attorney, Agent, or Firm*—Poms, Smith, Lande and Rose

[57] ABSTRACT

The invention is related to a tank for liquefied gas composed by a triple wall limiting three successive spaces from which two are insulation spaces.

The external insulation space contains a substance able to sublime and condense from gaseous state to solid state when cooled by a flow of liquefied gas caused by accidental failure into space.

An application is the construction of the tanks of methane carrier.

7 Claims, 4 Drawing Figures

Fig. 1
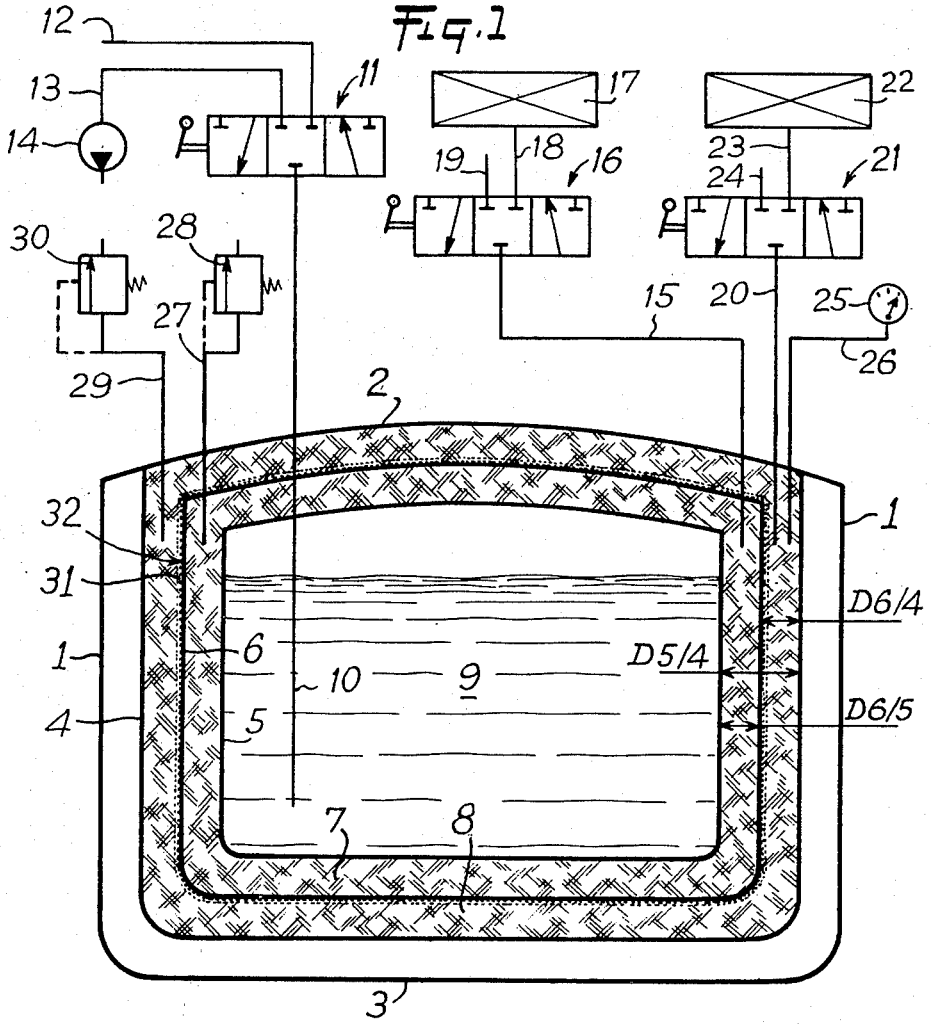
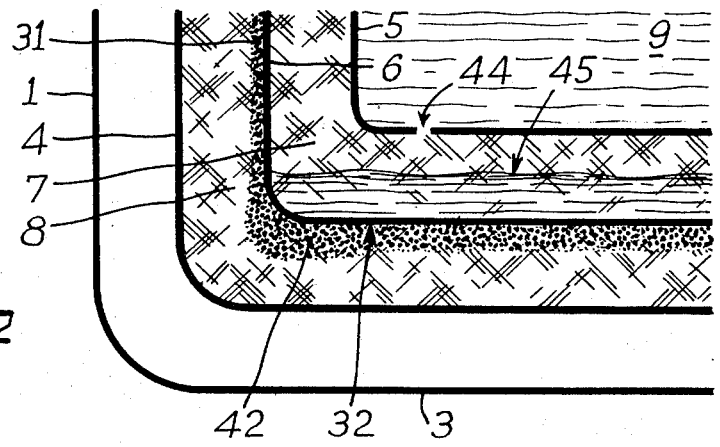
Fig. 2

STORAGE TANK FOR LIQUEFIED GAS SUCH AS METHANE

The invention is related to the design of liquefied gas tanks such as those built in gas carriers.

Such tanks are already known, see by instance the French Pat. No. 1,298,204. These tanks are built with three tight walls limiting first the space containing the liquefied gas but also two other safety and thermal insulation spaces which are usually filled with a thermally insulating material.

According to the same French patent the injection of a liquid into the space existing between the external wall and the adjacent wall is known; the purpose of this liquid being to be frozen at the contact with the liquefied natural gas and so to tightly stop up the interstices of the insulation installed inside the space under consideration.

Replacing this liquid by a substance which is normally gaseous, able to sublime by cooling, and so to condense to solid form without any intermediate liquid state is essentially the invention. This replacement allows to get many results which are new and unexpected in comparison with the results obtained using the techniques described in prior art, as it will be explained hereinafter. The fact that this invention is simple does not mean the invention is obvious and consequently the invention is patentable taking into account the prior art.

The invention is therefore related to a liquefied gas tank, such as liquefied methane, composed at least by:

a main, tight and resistant wall limiting the external space of the tank, an internal tight wall, so called primary barrier, located inside the external space and at a distance not null from the main wall and limiting the main space of the storage tank, an intermediate tight wall—so called secondary barrier—which is located in the space between the main wall and the primary barrier, at a distance not null from each other and limiting on one side between the primary barrier and itself a primary space and on the other side between the main wall and itself a secondary space, and a tightness fluid which is contained within the secondary space and which has a freezing point (temperature) first colder than the service temperature of the secondary space and second warmer than the temperature of the liquefied gas contained in the main space of the tank.

This tightness fluid is composed by at least a substance which, under a given pressure at least equal to the gas pressure of the liquefied gas contained in the main space, has a *sublimation* point (temperature) first, colder than the service temperature of the secondary space and second, warmer than the temperature of the liquefied gas contained in the main space of the tank, while the pressure within the secondary space is also effectively maintained equal to the said given pressure, the secondary space being besides connected to a selective supply reducing device feeding a gas under pressure.

The advantageous arrangements are also preferably provided as said below:

A part of the said selective supply reducing device feeding a gas under pressure is a selective valve delivering pressurized gas having at least two ways, when way number one is selected a source of gas under pressure is connected to secondary space and when way number two is selected the said connection is closed, this selective device being equipped, on one hand, with a mechanical spring acting to select way number one, on the other, with a controlling jack having an antagonistic section reacting against spring action, this jack being connected to secondary space.

A flowmeter is provided on the line between the secondary space and the selective supply reducing valve feeding a gas under pressure.

The secondary space is protected by a venting preset safety valve.

When the tank is designed in order to contain liquefied methane at atmospheric pressure the said substance is preferably carbon dioxide ($CO_2$), the sublimation temperature of carbon dioxide at the said given pressure is about minus 80° Celsius.

Each space primary and secondary is filled with a thermally insulating material; and, On the tank, a pressure gauge is provided for monitoring secondary space pressure, this pressure gauge being connected to this secondary space.

The invention will be more readily understood on reading the following description with reference to the accompanying drawings, in which:

FIG. 1 is a cross-sectional view of the hull of a gas carrier built with tanks according to the invention;

FIGS. 2 and 3 are cross-sectional views of a detail of FIG. 1, showing two other service configurations.

Figure 3:
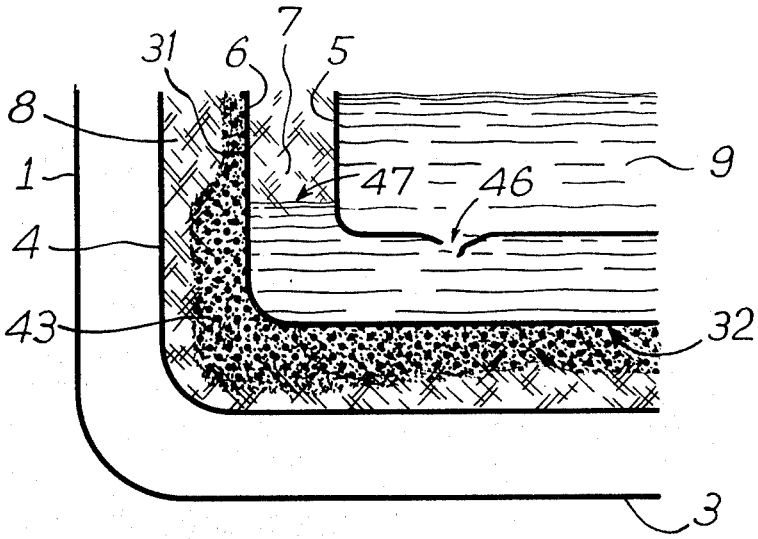

The tank shown on FIG. 1 is a tank of methane carrier and is formed by:

the outer hull including the lateral walls 1 welded to the deck 2 and to the bottom 3;

the double hull being a wall, said main wall, 4, tight, a part of which is the deck 2 itself and which is limiting the said external space of the tank;

an internal wall, tight, so called primary barrier 5, totally located inside the external space and at a distance D 5/4 not null from the main wall 4, which is limiting the main space 9 containing the liquid methane; and an intermediate wall, tight, so called secondary barrier 6, which is located between the main wall 4 and the primary barrier 5, at distances D 6/4 and D 6/5 likewise not null from each other.

Some spaces are formed between secondary barrier 6 and adjacent walls; they are:

primary space 7 which is filled with a thermal insulating material and which is limited between primary barrier 5 and secondary one 6 and, secondary space 8 which is likewise filled with a thermal insulating material and which is limited between secondary barrier and main wall 4.

This type of arrangement is known and the materials to be used also: ordinary mild steel for the hull 1-2-3 and for the double hull 4; special alloys resilient even at cryogenic temperatures with 5.5% or 9% or 36% nickel content or austenitic stainless steels 18/8 or special plywoods for primary barrier 5 and secondary one 6. The thermal insulating materials are, moreover, often permeable materials. In this case, their insulating properties are governed by the nature of absorbed gas: their fiber or powder structure is purposely choosen in order to minimize the motions of the molecules of the gas under consideration. Since carbon dioxide is a better insulant than nitrogen, the thermal insulation of the tank is consequently improved.

In order to prevent the leakage of liquefied methane at atmospheric pressure at about minus 160° Celsius, the primary and secondary spaces are pressurized using reducing supply devices feeding gas under pressure.

These supplies are:

gaseous nitrogen at 1.01 atmosphere into primary space 7, and, pure gas or mixture of gases containing compulsorily carbon dioxide at 1.01 or 1.02 atmosphere into secondary space 8.

It is easy to see that the pressure levels are low and that furthermore, there is no significant thrust resulting from the pressures of the gases acting on the walls of the various spaces, especially no buoyancy.

It is worthwhile to note that carbon dioxide can be replaced by any other gas having the physical property to SUBLIME i.e. to directly condense from gaseous state to solid state under the conditions as follows:

gaseous state, at the pressure of secondary space 8 (1.01 to 1.02 atmosphere) and at the average temperature of this secondary space obviously higher than the sublimation temperature of the gas under consideration (minus 80° Celsius about for carbon dioxide);

solid state, again at the pressure of secondary space 8, but at a temperature lower than the sublimation temperature, and, especially at the temperature of liquefied methane (minus 160° Celsius).

As it is generally the case when condensing from gaseous state to solid state, the gas under consideration will release the latent heat of sublimation.

Furthermore, if carbon dioxide or an equivalent gas, according to the meaning of above considerations, must compulsorily be present within the secondary space 8, another gas can be mixed with carbon dioxide or equivalent—the pressure of the mixture being obviously the same—this other gas may be, by instance, gaseous nitrogen.

The means provided to supply liquefied methane and pressurization gas are described hereinafter.

So, a line 10 leads to the bottom of the main space 9, this line is connected to a selective three ways valve 11, also connected to two other lines 12 and 13. The line 12 can be connected to a storage tank of liquefied methane, coming from a gas field, in order to load the tank. The other line 13 can be connected to a pump 14 to unload the tank.

The three ways of the selective valve 11 are corresponding to:

way number one, lines 10 and 12 are connected and line 13 is closed consequently the tank can be loaded.

way number two, the lines 10, 12, 13 are closed and way number three: lines 10 and 13 are connected, line 12 is closed, consequently the tank can be unloaded.

A line 15 is connecting the primary space 7 to a selective three ways reducing valve 16, while a nitrogen source—such as liquefied nitrogen pressure vessel storage tank 17 is connected to the selective valve 16 by a line 18.

A line 19 is connected to this selective valve venting to the external atmosphere.

The three ways of the selective reducing valve 16 are corresponding to:

Way number one, lines 15 and 18 are connected, line 19 is closed, consequently nitrogen gas can be fed into primary space 7.

Way number two, lines 15, 18, 19 are closed, and

Way number three, lines 15 and 19 are connected, line 18 is closed, consequently the primary space 7 is vent to the external atmosphere.

A line 20 is connecting the secondary space 8 to a selective three ways reducing valve 21, while a carbon dioxide source—such as a liquefied carbon dioxide pressure vessel storage tank 22 is connected to the selective valve 21 by a line 23. A line 24 is connected to this selective valve venting to the external atmosphere.

The three ways of the selective reducing valve 21 are corresponding to:

Way number one, lines 20 and 23 are connected, line 24 is closed, consequently gaseous carbon dioxide can be fed into secondary space 8.

Way number two, lines 20, 23 and 24 are closed; and

Way number three, lines 20 and 24 are connected, line 23 is closed, consequently the secondary space 8 is vent to the external atmosphere.

Furthermore, it has to be noticed:

A pressure gauge 25 is connected to secondary space 8 by a line 26;

A preset venting safety valve 28 is connected to primary space 7 by a line 27. The purpose of this safety valve is to avoid any overpressure inside the said primary space.

A preset venting safety valve 30 is connected to secondary space 8 by a line 29. The purpose of this safety valve is to avoid any overpressure inside the said secondary space;

The fact there is a thin layer of carbon dioxide frost 31 on the entire area of the outside surface 32 of the secondary barrier 6 limiting the secondary space 8.

Figure 4:
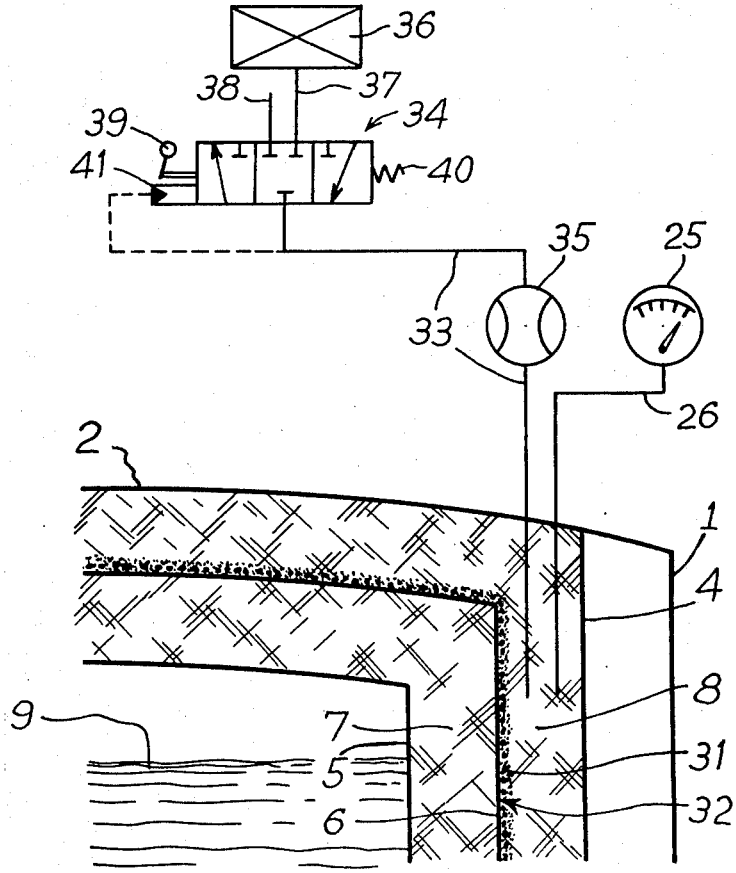
FIG. 4 is a cross-sectional view of a detail of an alternative construction of a tank built according to the invention.

FIG. 4 shows an alternative arrangement. On top of all what has been described and which is also used there is a line 33 connecting the secondary space 8 to a selective three ways reducing valve 34, a flowmeter 35 being installed on line 33. A pressure vessel type nitrogen source 36 is connected to the distribution valve 34 by a line 37. A line 38 is connected to this selective valve venting to the external atmosphere. It is worthwhile to note the selective reducing valve 34 is equipped with a selector lever 39 allowing to select the way in process but also with a mechanical spring 40 and with an automatic controlling jack 41 connected to the line 33. When the selector lever 39 is not used, the combined antagonistic effects resulting from the action of the mechanical spring 40 on one hand, and from the action of the pressure acting on the piston of the jack 41, on the other, the selective valve is maintained in way number two. If, on the contrary, an abnormal pressure reduction occurs within secondary space 8, the mechanical spring becomes the winner and consequently the selective valve is going to its way number one.

The three ways of the selective reducing valve 34 are corresponding to:

Way number one, lines 33 and 37 are connected, line 38 being closed, consequently compressed nitrogen gas can be fed into secondary space 8.

Way number two, lines 33, 37 and 38 are closed; and

Way number three, lines 33 and 38 are connected, line 37 being closed, consequently the secondary space 8 is vent to the external atmosphere.

FIG. 2 is showing what configuration occurs when the primary barrier 5 is slightly damaged by instance by a crack 44, through which liquefied methane is seeping into primary space 7. The liquefied methane accumulates in the bottom of this primary space 7 reaching a level 45. The temperature of the part of the secondary barrier wetted by the liquefied methane falls down to minus 160° Celsius and when touching this part, a thick layer 42 of carbon dioxide becomes solid by sublimation and releases its latent heat.

The damages of the tank might be more important so the configuration is such as shown on FIG. 3. The crevice 46 is passed through by an important quantity of liquefied methane reaching a level 47 within the secondary space. A more important quantity of carbon dioxide is condensed into solid state forming a very thick layer 43, as it was the case for the previous layer 42 but saturating most of the thermal insulating material and releasing more heat.

The way the above described arrangements are functioning will be now analysed.

In a classic manner known per se, a slight and progressive pressurization of primary space 7 and secondary space 8 was necessary above the gas pressure of the main space 9. The originality of the process under consideration is to pressurize the secondary space 8 using carbon dioxide normally in gaseous state.

The temperature of the secondary barrier 6 might be locally—after a certain time or under certain external conditions lower than the sublimation temperature of carbon dioxide but not as low as minus 160° Celsius, temperature of liquefied methane. Under these circumstances and at these spots a thin layer 31 of solid carbon dioxide exists what is besides improving the thermal insulation.

The selective reducing valve 21 and source 22 are feeding secondary space 8 with gaseous carbon dioxide.

In case of failure of primary barrier, the temperature of the part of secondary barrier 6 wetted by the liquefied methane falls down to minus 160° Celsius in such a way that this barrier is covered by a layer of solid carbon dioxide 42 or 43 more or less important, but sufficiently important to improve the thermal insulation so that the local temperature within the secondary space 8 at the limit and outside the layer 42 or 43 becomes higher than the sublimation temperature of carbon dioxide. On top of that, the layer 42, 43 stops up the possible cracks of secondary barrier 6 and heat is released when carbon dioxide is condensing.

Consequently the steel double hull 4 has been protected against lowering the steel temperature down to cryogenic temperatures at which the steel becomes fragile.

Furthermore, it is useful to have means available for detecting if a crack 44, 46 appears or exists. The first mean of such a detection is pressure gauge 25. At the moment where the solid layer 42, 43 is formed, there is a relative tendancy to the vacuum within secondary space 8—this vacuum can be specifically detected watching the readings of monitoring pressure gauge 25.

In the case of the configuration shown on FIG. 3 and perhaps even in the configuration shown by FIG. 2, it is necessary to restore the pressurization of secondary space 8, which has been momentarily annulled since a part of carbon dioxide condensed into solid state. This restoration of pressurization can be achieved using two possible ways. Obviously, it is possible to introduce into secondary space 8 a new quantity of carbon dioxide (source 22) but it may occur that this source is exhausted (carbon dioxide tank empty—by instance) and that, besides, an additional quantity of carbon dioxide is not essential in order to stop up the cracks. In this event, it is possible to restore the pressurization injecting, into secondary space 8, an other gas under pressure such as nitrogen from pressure tank 36.

Besides, this new pressurization can be automatically achieved using selective reducing valve 34. Actually, if there is a certain tendancy to the vaccum within secondary space 8, the piston of the jack 41 cannot anymore maintain this selective valve in way number two, the spring 40 pushes the selective valve into way number one.

It is worth noting that watching flowmeter 35 allows to detect a high flow of gas supplied into secondary space 8 and, consequently to detect if cracks 44, 46 exist or not.

When the main space 9 is warmed up, either for repairs or periodical surveys, it is obviously worth avoiding the reverse transformation of carbon dioxide from solid state to gaseous state increases the pressures until dangerous conditions are reached for primary barrier 5 and secondary one 6. The preset venting safety valves 28 and 30 avoid such dangerous overpressures.

So, using the recommended arrangements, we can see that failures detection of primary barrier 5 is easy;

that the thermal insulation is reinforced as well as the tightness of primary barrier 5 and secondary one 6;

that the secondary barrier 6 becomes a self-healing one if either damaged or simply imperfectly made.

It is important mentioning the remarkable following characteristic: the brackets and linking elements of primary barrier and secondary one 6 are constituting on one hand, weak points of these barriers and thermal leakages on the other hand. As a result of the latter, there is a deposit of carbon dioxide frost on these elements as soon the tank is in normal service. This frost is consequently reinforcing the thermal insulation in the surroundings of the brackets and similar on one hand, and consequently in the weakest areas of the primary and secondary barriers on the other hand and that as soon as the tank is in normal service.

In case of failure, the curative remedy is already at the right spot—at least partially.

It is also worth noting the following facts:

some arrangements described in prior art were tentative plans to use carbon dioxide in order to complete the thermal insulation of a single thermal barrier located between two walls only; it has been demonstrated that this process was not satisfactory at all since huge quantities of carbon dioxide were necessary. The carbon dioxide, besides, sublimes quasi-instantaneously so no more carbon dioxide stays in gaseous state. According to the lessons of prior art, there was an indication leading to disregard any process using carbon dioxide. The first novelty of the invention has been to overcome this preconceived unfavorable opinion and to think to use the process for double thermal barriers (spaces 7 and 8). It has been effectively demonstrated by the experience that, within secondary space 8, the temperature is permanently high enough in order a part of carbon dioxide contained in this space 8 remains in gaseous state, especially available to sublime when touching the surface 32, only when it is needed this surface becoming too cold;

the fact that in space 8, a great part of carbon dioxide remains in gaseous state is of interest because the thermal conductivity of this gas is low and lower than nitrogen gas thermal conductivity. Consequently, the sought thermal insulation is reinforced;

another important fact is that when subliming, carbon dioxide releases a certain amount of heat, this heat is warming up what is contained in space 8 and by this mean, the main wall 4 also consequently avoiding an excessive lowering of the wall temperature deleting besides, the necessity to provide another mean of heating;

finally, as an indication, it has to be noticed that carbon dioxide gas can be prepared using propulsion plants exhaust gases as rough materials—especially those coming from ships propulsion plants—this fact is of economical interest for a process using carbon dioxide.

The invention is in no way limited to the description given hereinabove and on the contrary, covers all modifications that can be brought thereto without departing from the scope and the spirit thereof.

What is claimed is:

1. A tank adapted for use in storing and transporting liquefied gas comprising:

an internal vessel having a primary barrier wall defining a main space in which said liquefield gas is contained at a given pressure;

an intermediate vessel having a secondary barrier wall surrounding said internal vessel and defining a primary space between said internal vessel and said intermediate vessel;

an outer hull having a main wall surrounding said intermediate vessel and defining a secondary space between said intermediate vessel and said outer hull;

a gas located within said secondary space at a pressure at least equal to the pressure of said liquefied gas, said gas having a sublimation temperature at or above the temperature of said liquefied gas, but below the service temperature of said secondary space whereby said gas freezes by sublimation to form a solid barrier upon leakage of liquefied gas from said main space into said primary space; and means connected to said secondary space for selectively feeding gas under pressure to said secondary space.

2. A tank according to claim 1 wherein said means for selective feeding includes a selective supply reducing device having a selective reducing valve for delivering pressurized gas in at least two ways wherein when way number one is selected, a source of gas under pressure is connected to said secondary space and when way number two is selected said connection is closed, this selective device being equipped on one hand, with a mechanical spring acting to select way number one and on the other hand with a controlling jack having an antagonistic action reacting against said spring action, this jack being connected to said secondary space.

3. A tank as claimed in claim 2, wherein a flowmeter is provided on the line between the secondary space and the selective supply reducing valve feeding a gas under pressure.

4. A tank as claimed in claim 1 wherein the secondary space is protected by a venting preset safety valve.

5. A tank as claimed in claim 1, wherein the tank is designed in order to contain liquefied methane at atmospheric pressure, said gas being carbon dioxide the sublimation temperature of which at said given pressure is about minus 80° Celsius.

6. A tank as claimed in claim 1, wherein each primary and secondary space is filled with a thermally insulating material.

7. A tank as claimed in claim 1, wherein a pressure gauge is provided for monitoring secondary space pressure.

* * * * *